US006093045A

United States Patent [19]

Hoff

[11] Patent Number: 6,093,045

[45] Date of Patent: Jul. 25, 2000

[54] ELECTRICAL CONNECTOR MODULE AND KIT HAVING TAMPER PROOF LATCH MECHANISM

[75] Inventor: Matthew J. Hoff, Jamestown, N.Y.

[73] Assignee: Osram Sylvania Inc., Danvers, Mass.

[21] Appl. No.: 08/614,558

[22] Filed: Mar. 13, 1996

[51] Int. Cl.[7] ..... H01R 13/627

[52] U.S. Cl. ..... 439/357; 439/274

[58] Field of Search ..... 439/274, 275, 439/279, 353, 357, 587, 350, 351

[56] References Cited

U.S. PATENT DOCUMENTS

| | | | |
|---|---|---|---|
| 3,880,487 | 4/1975 | Goodman et al. | 439/279 |
| 4,402,564 | 9/1983 | Frantz | 439/350 |
| 4,639,061 | 1/1987 | Muzslay | 439/587 |
| 5,110,302 | 5/1992 | Kobler | 439/357 |
| 5,368,499 | 11/1994 | Hirt | 439/350 |
| 5,454,729 | 10/1995 | Wen-Te | 439/357 |
| 5,536,103 | 7/1996 | Sawada | 439/274 |

*Primary Examiner*—Gary F. Paumen
*Assistant Examiner*—Katrina Davis
*Attorney, Agent, or Firm*—William H. McNeill

[57] ABSTRACT

A connector module and a connector module kit which includes the components of the connector module, is provided. The connector module includes a first housing formed to house at least one first contact therein and a second housing formed to house at least one second contact therein. Insertion of the second housing into the first housing will cause each first contact to mate with each second contact. Such insertion also causes a latching mechanism located within the assembled first and second housing to latch the housings together so that they can not be readily disengaged.

15 Claims, 4 Drawing Sheets

ELECTRICAL CONNECTOR MODULE AND KIT HAVING TAMPER PROOF LATCH MECHANISM

TECHNICAL FIELD

The present invention relates to a connector module comprising positive locking members. The present invention is particularly useful in providing a connector module, for electrical connections, comprising positive locking members which may not be readily disengaged.

BACKGROUND ART

It is occasionally desirable to provide electrical connectors which may be mechanically and electrically connected together but not readily disconnected. For example, the ability to easily disconnect an electrtical connector creates a potential safety hazard in high voltage applications. Such a concern exists in some electrical connections located under the hood of a motor vehicle. One known device to deter separation of electrical connectors involves using threaded nuts and bolts to hold mated connectors together. The use of nuts and bolts in this manner is inherently time consuming. In addition, space limitations may impede effecting the connection. Further, such a connection may be disconnected by merely unthreading the bolts and nuts. Another known device relies upon a friction fit to hold mating parts together. An environment such as that provided by a motor vehicle may cause this type of connection to vibrate loose. In addition, such a connection may be disconnected merely by using enough force to pull the connectors apart. It is also known to provide mating connector housings which are snap fit together, a lock disabler being provided to prevent unsnapping thereof. U.S. Pat. No. 5,370,550 is an example of such a device. However, a device of this type may be disconnected, if desired. Other known devices rely upon the use of connector position assurance (CPA) members such as described in U.S. Pat. No. 5,236,373. In structures of this type the CPA engages mating connector housings to lock such housings together. A device of this type requires the use of an additional part in the assembly, and in particular requires the use of the CPA.

DISCLOSURE OF THE INVENTION

It is, therefore, an object of the present invention to provide a connector module which obviates the disadvantages of the prior art.

It is yet another object of the present invention to provide a connector module which cannot be readily disengaged when in a mated state.

It is another object of the present invention to provide such a connector module requiring a minimum number of parts.

A further object of the present invention is to provide such a connector module having a latching mechanism which is hidden from view when in a mated state.

Yet another object of the present invention is to provide such a connector module which comprises mating housings which provide tactile feedback when connected together.

Another object of the present invention is to provide such a connector module which is particularly useful in high voltage applications.

A further object of the present invention is to provide a relatively simple connector module, the components of which may be in kit form.

This invention achieves these and other objects by providing a connector module. A connector kit is also provided which includes each of the components of the connector module. The connector module comprises a first housing having at least one first contact positioned therein. The first housing comprises at least one first latch engagement member. A second housing is provided having at least one second contact there. The second housing comprises at least one second latch engagement member. When assembled, the second housing extends into the first housing, each first contact is electrically and mechanically connected to each second contact, and each first latch engagement member is latched to a respective second latch engagement member at a position inside the first housing.

BEST MODE FOR CARRYING OUT THE INVENTION

Figure 1:
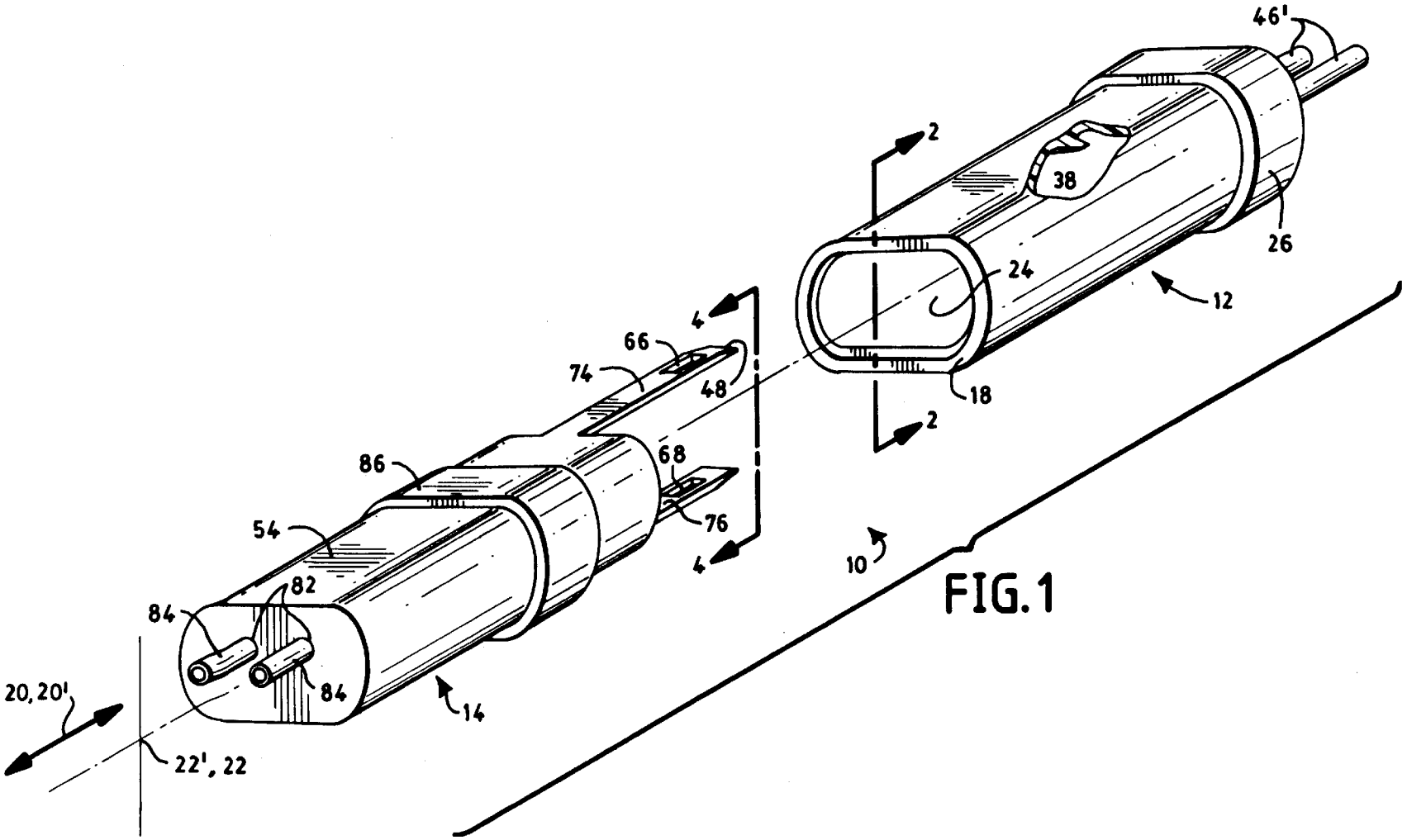
FIG. 1 is an exploded perspective view of the connector module of the present invention.

For a better understanding of the present invention, together with other and further objects, advantages and capabilities thereof, reference is made to the following disclosure and appended claims taken in conjunction with the above-described drawings.

Referring now to the drawings with greater particularity, there is illustrated in FIGS. 1 to 6 a connector module 10 which comprises a non-conductive first housing 12 and a mating non-conductive second housing 14.

Figure 3:
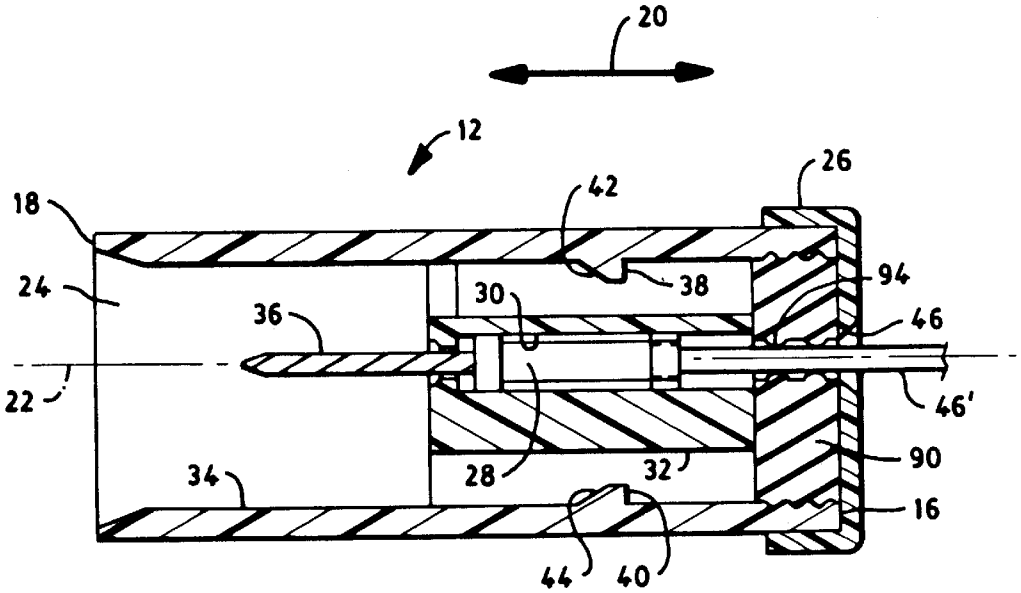
FIG. 3 is a partial section view of FIG. 2, taken along lines 3—3.
Figure 2:
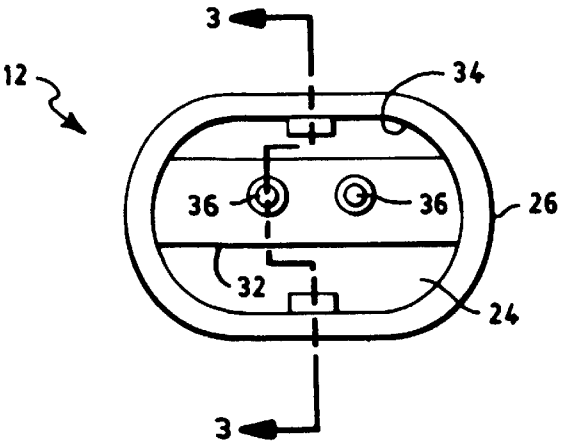
FIG. 2 is an end view of a first housing 12 of FIG. 1 taken along lines 2—2.

With particular reference to FIG. 3, the housing 12 extends from an end 16 to an opposite end 18 in a direction 20 of a longitudinal axis 22. Housing 12 comprises a cavity 24 therein and a cover 26 which encloses the end 16. Each of the non-conductive housings of the present invention contain at least one contact therein. In the embodiment of FIGS. 1 to 6, two contacts 28 are positioned in the cavity 24. Contacts 28 are each press fit into a respective bore 30 of a portion 32 of the housing 12 which extends into cavity 24 from an inner surface 34 of the housing. Each contact 28 comprises a male prong 36 which extends in direction 20 towards end 18.

Inner surface 34 of housing 12 comprises at least one latch engagement member. In the embodiment of FIGS. 1 to 6, two latch engagement members are provided in the form of protuberances 38 and 40 each of which extends into the cavity 24 towards axis 22 from surface 34. In the preferred embodiment, the latch engagement member, such as each protuberance 38 and 40, comprises a cam surface such as cam surfaces 42 and 44, respectively.

In a preferred embodiment of the present invention, cover 26 comprises at least one aperture through which a conductor extends for connection to a contact housed within the housing 12. For example, in the embodiment of FIGS. 1 to 6, cover 26 comprises two apertures 46 (only one is visible in the drawings) through which respective conductors 46' extend. An end of each conductor 46' is electrically and mechanically connected to a respective contact 28, as for example, by soldering the conductor to the contact. Cover 26 may be permanently attached to the housing 12 in those connector modules which are designed to be maintenance free. To this end, the cover 26 may be sonic welded to the housing 12 in a conventional manner. In those connector modules which are designed to require internal maintenance, the cover 26 may be removably attached to the end 16 of the housing 12, as, for example, by providing a conventional snap fit.

Figure 5:
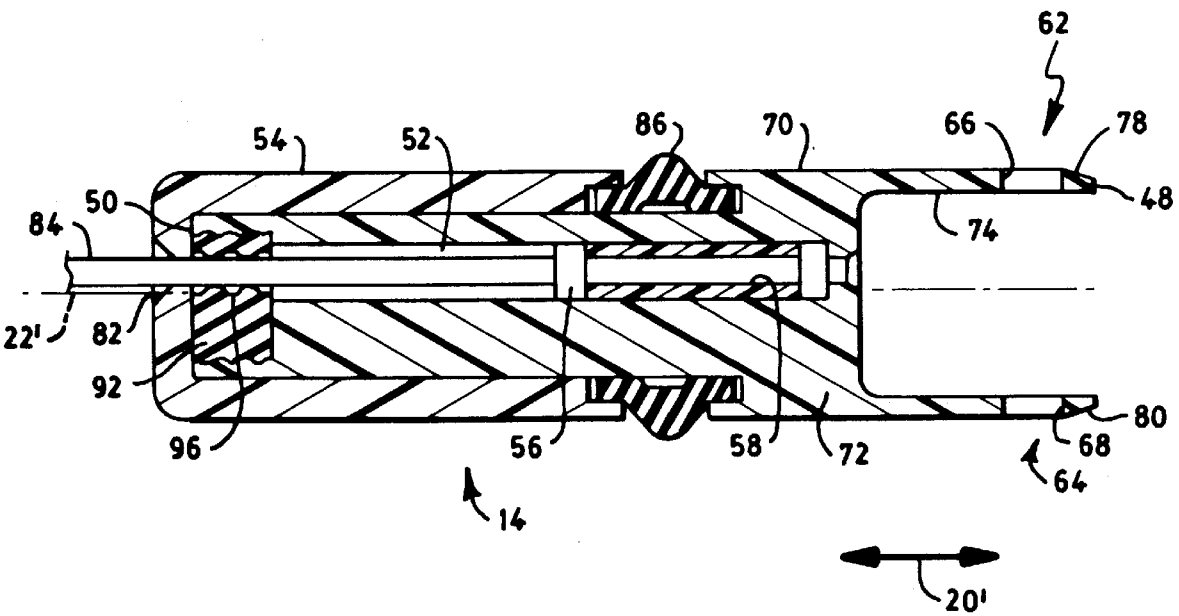
FIG. 5 is a partial section view of FIG. 4, taken along line 5—5.
Figure 4:
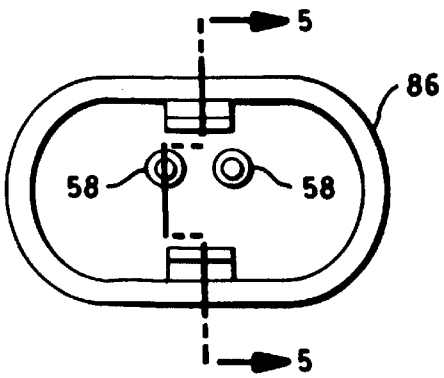
FIG. 4 is an end view of a second housing 14 of FIG. 1 taken along lines 4—4.

With particular reference to FIG. 5, the housing 14 extends from an end 48 to an opposite end 50 in the direction 20' of longitudinal axis 22'. Housing 14 comprises two bores 52 which extend in direction 20' from end 48 to end 50. A cover 54 is provided which encloses the end 50. A contact 56 is positioned in each bore 52. Each contact 56 is press fit in a respective bore 52 to hold the contact in place relative to housing 14. Each contact 56 comprises a female ferrule 58 which extends in direction 20' towards end 48.

The outer surface of the housing 14 comprises at least one latch engagement member. In the embodiment of FIGS. 1 to 6, two latch engagement members 62 and 64 are provided which comprise openings 66 and 68 which extend into an outer surface 70 of the housing 14.

In the embodiment of FIGS. 1 to 6, the housing 14 comprises a segment 72 which extends from end 50 towards end 48 and two resilient beams 74 and 76 which extend from the segment 72 to end 48. The outer surfaces of beams 74 and 76 comprise an extended portion of the outer surface 70 of the housing 14. In the preferred embodiment, the openings 66 and 68 extend entirely through respective beams 74 and 76 as depicted in FIG. 5. In the preferred embodiment, the latch engagement members 62 and 64 comprises cam surfaces 78 and 80, respectively. As the housings 12 and 14 are mated by inserting end 48 of housing 14 into cavity 24 of housing 12, the cam surfaces 78 and 80 engage respective cam surfaces 42 and 44 which causes the beams 74 and 76 to be deflected towards axis 22'. The beams 74 and 76 return to their normal position as the protuberances 38 and 40 snap into respective opening 66 and 68 to lock the housings 12 and 14 together.

Figure 6:
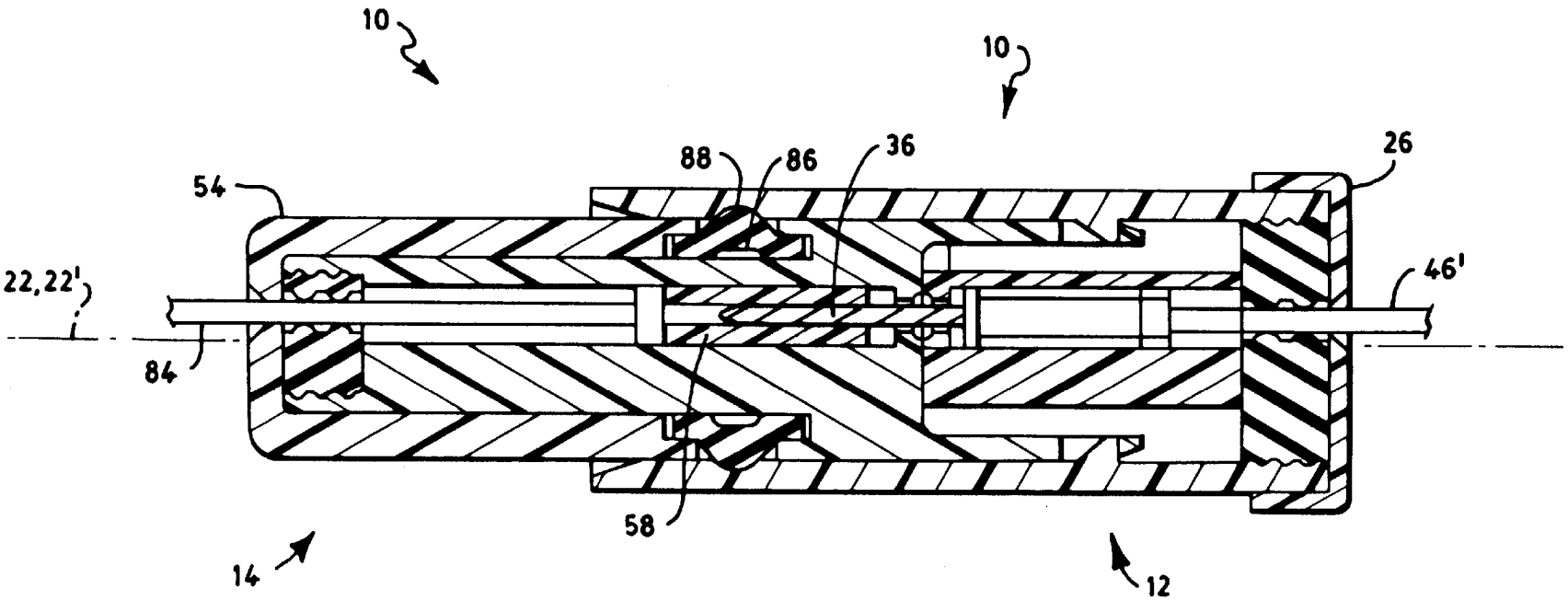
FIG. 6 is a view of FIGS. 3 and 5 mated together.

Although two beams 74 and 76, and two mating protuberances 38 and 40, are provided, more or less of such beams and mating protuberances may be provided. In addition, it will be apparent to those having ordinary skill in the art that the protuberances and openings may be reversed such that the openings in the beams 74 and 76 are replaced with protuberances and the protuberances extending from the inner surface 34 are replaced with openings which mate with such protuberances. As depicted in FIG. 6, regardless of the number of protuberances and mating openings, when the housings 12 and 14 are properly mated together, the latching mechanism provided by such protuberances and mating openings will be positioned within the connector module 10 so that the latching mechanism may not be readily disengaged and is hidden from view.

In a preferred embodiment of the present invention, cover 54 comprises at least one aperture through which a conductor extends for connection to a contact housed within the housing 14. For example, in the embodiment of FIGS. 1 to 6, cover 54 comprises two apertures 82 through which conductors 84 extend. An end of each conductor 84 is electrically and mechanically connected to a respective contact 56, as, for example, by soldering the conductor to the contact. Cover 54 may be permanently attached to the housing 14 in those connector modules which are designed to be maintenance free. To this end,the cover 54 may be sonic welded to the housing 14 in a conventional manner. In those connector modules which are designed to require internal maintenance, the cover 54 may be removably attached to the end 50 of the housing 14, as, for example, by providing a conventional snap fit.

As depicted in FIG. 6, when the connector module 10 is assembled, the housing 14 extends into housing 12, the prongs 36 of contacts 28 are electrically and mechanically connected to the ferrules 58 of contacts 56, and the latch engagement members of housing 12 are latched to respective latch engagement members of housing 14. In particular, the end 48 of the housing 14 extends into cavity 24 of housing 12 from end 18, and the protuberances 38 and 40 extend into respective openings 66 and 68.

In order to provide a connector module 10 which is environmentally sealed, the housing 14 may be provided with a seal 86 which extends around an outer periphery of the housing. When connector housings 12 and 14 are connected together, the seal 86 sealingly engages the inner surface 34 as depicted in FIG. 6. If desired, inner surface 34 may comprise a groove 88 into which seal 86 may nest upon assembly of the connector module 10. Seals 90 and 92 may also be provided at end 16 and end 50 of housings 12 and 14, respectfully. Each seal 90 and 92 comprises bores 94 and 96, respectively, through which respective conductors 46 and 84 extend in a sealing relationship.

Fabrication of the various components described herein may be accomplished using conventional procedures. For example, the housings and housing covers may be molded from a plastic material. Similarly, the seals described herein may be molded from rubber or elastomeric material. The conductive male and female contacts may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector module comprising:

a first housing having at least one first contact positioned therein, said first housing comprising at least one first latch engagement member; said first housing extending from a first end to a second end in a first direction of a first longitudinal axis, said first housing further comprising a first cavity therein and a first cover enclosing said first end, said at least one first contact being positioned in said first cavity and extending in said first direction towards said second end, said at least one first latch engagement member comprising at least one protuberance which extends into said first cavity towards said first axis from an inner surface of said first housing, and further wherein said second housing extends from one end to an opposite end in a second direction of a second longitudinal axis, said second housing comprising at least one bore which extends in said second direction from said one end to said opposite end and a second cover enclosing said opposite end, said at least one second contact being positioned in said at least one bore and extending in said second direction towards said one end, said at least one second latch engagement member comprising at least one opening which extends into an outer surface of said second housing, said one end of said second housing extending into said first cavity of said first housing from said second end, and said at least one protuberance extending into said at least one opening; and a second housing having at least one second contact therein, said second housing comprising at least one second latch engagement member, said second housing extending into said first housing, said at least one first contact electrically and mechanically connected to said at least one second contact, and said at least one first latch engagement member being latched to said at least one second latch engagement member at a position inside said first housing, said second housing further comprising a segment which extends from said opposite end towards said one end, and further comprises at least one beam which extends from said segment to said one end, an outer surface of said at least one beam comprising a portion of said outer surface of said second housing.

2. The connector module of claim 1 wherein said first cover comprises at least one first aperture, and further wherein at least one first conductor extends through said at least one first aperture into said first cavity and is attached to said at least one first contact, and said second cover comprises at least one second aperture, and further wherein at least one second conductor extends through said at least one second aperture into said at least one bore and is attached to said at least one second contact.

3. The connector of claim 2 wherein said first cover is permanently attached to said first housing and said second cover is permanently attached to said second housing.

4. The connector of claim 2 wherein said first cover is removably attached to said first housing and said second cover is removably attached to said second housing.

5. The connector of claim 1 wherein said at least one opening extends through said at least one beam.

6. The connector of claim 1 wherein said second housing comprises a seal which extends around an outer periphery of said second housing, said seal sealingly engaging an inner surface of said first housing.

7. The connector of claim 1 wherein said at least one first latch engagement member comprises a cam surface and said at least one second latch engagement member comprises a mating cam surface.

8. A connector kit, comprising:

a first housing, said first housing comprising at least one first latch engagement member and being adapted to have inserted therein at least one first contact, said first housing extending from a first end to a second end in a first direction of a first longitudinal axis of said first housing, said first housing comprising a first cavity therein, said first cavity being adapted to receive each first contact, said at least one first latch engagement member comprising at least one protuberance which extends into said first cavity towards said first axis from an inner surface of said first housing, and further wherein said second housing extends from one end to an opposite end in a second direction of a second longitudinal axis of said second housing, said second housing comprising at least one bore which extends in said second direction from said one end to said opposite end, said at least one bore being adapted to receive each second contact, said at least one second latch engagement member comprising at least one opening which extends into an outer surface of said second housing, said one end of said second housing being adapted to be inserted into said first cavity of said first housing from said second end, and said at least one protuberance being adapted to be inserted into said at least one opening, said kit further comprising a first cover adapted to enclose said first end and a second cover adapted to enclose said opposite end; and a second housing, said second housing comprising at least one second latch engagement member and being adapted to have inserted therein at least one second contact, said second housing being adapted for insertion into said first housing such that each first contact inserted in said first housing is electrically and mechanically connected to a respective second contact inserted in said second housing, said at least one first latch engagement member being adapted to be latched to said at least one second latch engagement member at a position inside said first housing, said second housing further comprising a segment which extends from said opposite end towards said one end, and at least one beam which extends from said segment to said one end, an outer surface of said at least one beam comprising a portion of said outer surface of said second housing.

9. The connector kit of claim 8 wherein said first cover comprises at least one first aperture and said second cover comprises at least one second aperture.

10. The connector kit of claim 9 wherein said first cover is adapted to be permanently attached to said first housing and said second cover is adapted to be permanently attached to said second housing.

11. The connector kit of claim 9 wherein said first cover is adapted to be removably attached to said first housing and said second cover is adapted to be removably attached to said second housing.

12. The connector kit of claim 8 wherein said at least one opening extends through said at least one beam.

13. The connector of claim 8 wherein said second housing comprises a seal which extends around an outer periphery of said second housing, said seal being adapted to sealingly engage an inner surface of said first housing.

14. The connector of claim 8 wherein said at least one first latch engagement member comprises a cam surface and said at least one second latch engagement member comprises a mating cam surface.

15. A connector module, comprising:

a first housing comprising at least one first latch engagement member; and a second housing comprising at least one second latch engagement member, said second housing being formed to extend into said first housing, and said at least one first latch engagement member being formed to latch to said at least one second latch engagement member at a position inside said first housing, said second housing further comprising a segment at one end of said second housing and at least one beam extending from said segment to an opposite end of said second housing, said at least one beam comprising said at least one second latch engagement member.

* * * * *